US008303104B2

(12) United States Patent
Miyagi

(10) Patent No.: US 8,303,104 B2
(45) Date of Patent: Nov. 6, 2012

(54) INKJET RECORDING APPARATUS AND IMAGE FORMING APPARATUS

(75) Inventor: Takashi Miyagi, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 318 days.

(21) Appl. No.: 12/724,659

(22) Filed: Mar. 16, 2010

(65) Prior Publication Data

US 2010/0231676 A1 Sep. 16, 2010

(30) Foreign Application Priority Data

Mar. 16, 2009 (JP) ..... 2009-062939
Oct. 14, 2009 (JP) ..... 2009-237230

(51) Int. Cl.
*B41J 2/01* (2006.01)

(52) U.S. Cl. ..... 347/104; 347/23; 347/101; 347/102; 346/139 R

(58) Field of Classification Search ..... None
See application file for complete search history.

(56) References Cited

U.S. PATENT DOCUMENTS 6,409,332 B1 * 6/2002 Yraceburu et al. ..... 347/104
6,918,650 B2 * 7/2005 Umeda et al. ..... 347/30
7,083,274 B2 * 8/2006 Morita et al. ..... 347/104
2002/0109768 A1 * 8/2002 Greive ..... 347/104
2007/0146456 A1 * 6/2007 Tanabe ..... 347/101
2007/0291096 A1 * 12/2007 Toyoshima ..... 347/104

FOREIGN PATENT DOCUMENTS

JP 2003-341106 12/2003
JP 2004-106359 4/2004
JP 2006-159556 6/2006
JP 2007-168277 7/2007

OTHER PUBLICATIONS

U.S. Appl. No. 12/574,966, filed Oct. 7, 2009.
U.S. Appl. No. 12/635,939, filed Dec. 11, 2009.

* cited by examiner

*Primary Examiner* — Matthew Luu
*Assistant Examiner* — John P Zimmermann
(74) *Attorney, Agent, or Firm* — Cooper & Dunham LLP

(57) ABSTRACT

An inkjet recording apparatus to print onto a surface of a recording medium includes an endless rotation conveyance member with a plurality of through-holes; a suction unit to suction the recording medium on the surface of the endless rotation conveyance member; an ink discharge head including ink discharge nozzles; a blank discharge ink receiver to receive ink through the through-holes; a control unit to make the ink discharge nozzles discharge ink at a predetermined timing; and a fixed plate along an inner surface of the endless rotation conveyance member, the fixed plate including an opening formed in a position corresponding to the ink discharge nozzles and a through-hole. The blank discharge ink receiver is disposed corresponding to the opening of the fixed plate and in close contact with the fixed plate so that an inside space of the blank discharge receiver becomes a substantially closed space.

15 Claims, 14 Drawing Sheets

INKJET RECORDING APPARATUS AND IMAGE FORMING APPARATUS

BACKGROUND OF THE INVENTION

1. Field of the Invention

The present invention relates to inkjet recording apparatuses and image forming apparatuses. More specifically, the present invention relates to an inkjet recording apparatus that prints on a recording medium (which is hereinafter called a paper sheet) conveyed by a conveyance member such as a conveyor belt by discharging ink from nozzles in an ink discharging head, and an image forming apparatus that utilizes the inkjet recording apparatus.

2. Description of the Related Art

Conventionally, in an inkjet recording apparatus, a so-called "blank discharge" is generally performed to maintain a sufficient ink discharge by always preventing nozzles in an ink discharge head from drying, other than nozzle maintenance performed before starting the next print job. In the blank discharge, the nozzles discharge ink irrelevant to image forming toward an area above a paper sheet being conveyed during printing, a conveyance member between the paper sheets, or a blank discharge ink receiver disposed behind a conveyance unit through a paper sheet suction hole provided in the conveyance member or through an opening provided in the conveyance member only for the blank discharge.

However, it sometimes happens that the blank discharge contaminates a surface of a conveyor belt with the ink because a head nozzle faces the surface of the conveyor belt that is the conveyor member, on a paper sheet supporting side. To prevent such contamination, a technique that displaces the conveyor belt, and carries an ink receiver for the blank discharge into a position where the conveyor belt has existed, is proposed. However, the inkjet recording apparatus in this technique has a complex structure and has grown in size as a whole, and even causes a decrease of printing efficiency because a transfer action for the conveyor belt being displaced and carrying the ink receiver in place of the conveyor belt make a printing interruption time longer.

In Japanese Laid-open Patent Application Publication No. 2007-168277 (which is hereinafter called Patent Document 1), a blank discharge in an inkjet recording apparatus is disclosed. In the blank discharge, a nozzle discharges ink irrelevant to image forming toward a blank discharge ink receiver disposed behind a conveyor belt through a paper sheet suction hole provided in the conveyor belt at a proper timing during printing. In Patent Document 1, corresponding to the blank discharge, the inkjet recording apparatus includes the blank discharge ink receiver that is large enough to be able to receive even spreading blank discharge ink. However, even if the blank discharge ink receiver has such a large size, a small ink droplet, especially misty ink, tends to float up in the air around a blank discharge receiver part, which sometimes causes the ink to overflow outside the ink receiver from a gap between the ink receiver and an opposing face plate. In particular, when a suction unit (e.g., suction fan) for suctioning a paper sheet is provided, the inside of the blank discharge ink receiver is reduced to a negative pressure due to air flow caused by the suction fan, and even a relatively big ink droplet once returned to the blank discharge ink receiver falls out of the gap between the blank discharge ink receiver and the opposing face plate. This sometimes causes not only a decrease of an ink recovery rate, but also an accumulation of contamination by the blank discharge ink around the blank discharge receiver, and diffuse emission of the blank discharge ink outside the inkjet recording apparatus by the paper sheet suction fan.

An explanation is given by using drawings. FIG. 1 is a diagram showing a side of a conventional public blank discharge ink receiver 22. FIG. 1 shows a blank discharge ink recovery mechanism that includes blank discharge ink receivers 22Y through 22K arranged along a recording head line. A paper sheet is suctioned and carried from the left to the right of FIG. 1. In FIG. 1, a part of the blank discharge ink receivers and the recording heads are omitted for reduction of the drawing. The recording heads 18Y through 18K respectively include plural head nozzles arranged in a direction perpendicular to a paper sheet conveyance direction (i.e., a direction perpendicular to the plane of paper of FIG. 1). The blank discharge ink receivers 22Y through 22K have a length capable of accepting an ink droplet flow discharged from the head nozzles for the blank discharge (which is hereinafter called a blank discharge ink flow; refer to FIG. 18).

A suction fan 23 is provided under the blank discharge ink receiver 22 as a paper sheet suction unit, which makes it possible to suction and hold the paper sheet carried onto a surface of a conveyor belt 8 through plural suction holes 8*a* provided through the conveyor belt 8 and plural suction holes 13*a* provided through a belt flexure prevention member 13, and to carry the paper sheet.

In a configuration shown in FIG. 1, when a blank discharge ink flow 19 flows into an inside space of the blank discharge ink receiver 22 as shown in FIG. 2, air flows into not only the suction holes 13*a* provided in the flexure prevention member 13, but also openings 13*b* for the blank discharge ink provided facing the head nozzles. Here the openings for the blank discharge ink 13*b* are provided to let the blank discharge ink flow 19 through due to the suction fan 23 of the paper sheet suction unit. Because the air flows along a side piece of the blank discharge ink receiver 22, the inside of the blank discharge ink receiver 22 is reduced to a negative pressure state. Due to this, as shown in FIG. 3, the blank discharge ink flow 19 that first flows into the blank discharge ink receiver 22 does not stay in the inside space of the blank discharge ink receiver 22, and a part of the blank discharge ink flow 19 leaks out from a top edge 22*a* of the blank discharge ink receiver 22 as an outward ink flow 19*a*.

SUMMARY OF THE INVENTION

Accordingly, embodiments of the present invention may provide a novel and useful inkjet recording apparatus and an image forming apparatus solving or reducing one or more of the above-described problems.

More specifically, the embodiments of the present invention may provide an ink-jet recording apparatus and an image forming apparatus to prevent decrease of a recovery rate of blank discharge ink that is recovered once and to prevent contamination of the periphery of a blank discharge ink receiver by leaked ink.

According to one embodiment of the present invention, an inkjet recording apparatus is provided to print by discharging ink onto a surface of a recording medium, the apparatus including:

an endless rotation conveyance member with a plurality of through-holes to support the recording medium on its surface;

a suction unit to suction the recording medium on the surface of the endless rotation conveyance member by suctioning air through the through-holes of the endless rotation conveyance member;

an ink discharge head including a plural of ink discharge nozzles arranged in a direction perpendicular to a recording medium conveyance direction;

a blank discharge ink receiver to receive ink discharged from the ink discharge nozzles and passing through the through-holes, the blank discharge ink receiver being disposed in a position corresponding to the ink discharge nozzles in an inner circumference area of the endless rotation conveyance member;

a control unit to cause the ink discharge nozzles to discharge the ink when there is no recording medium on the endless rotation conveyance member and the through-holes come to a position facing the ink discharge nozzles; and a fixed plate provided along an inner surface of the endless rotation conveyance member in the inner circumference area, the fixed plate including an opening formed in a position corresponding to the ink discharge nozzles and a through-hole to suction air, wherein the blank discharge ink receiver is disposed corresponding to the opening of the fixed plate and in close contact with the fixed plate so that an inside space of the blank discharge receiver becomes a substantially closed space.

According to another embodiment of the present invention, an image forming apparatus including an inkjet recording device is provided to print by discharging ink onto a surface of a recording medium, the apparatus including:

a medium feeding part to provide the recording medium for the inkjet recording device provided upstream of the inkjet recording device in a recording medium conveyance direction;

an endless rotation conveyance member with a plurality of through-holes to support the recording medium on its surface;

a suction unit to suction the recording medium on the surface of the endless rotation conveyance member by suctioning air through the through-holes of the endless rotation conveyance member;

an ink discharge head including a plurality of ink discharge nozzles arranged in a direction perpendicular to a conveyance direction of the recording medium;

a blank discharge ink receiver to receive ink discharged from the ink discharge nozzles and passing through the through-holes, the blank discharge ink receiver being disposed in a position corresponding to the ink discharge nozzles in an inner circumference area of the endless rotation conveyance member;

a control unit to cause the ink discharge nozzles to discharge the ink when there is no recording medium on the endless rotation conveyance member and the through-holes come to a position facing the ink discharge nozzles;

a fixed plate provided along a inner surface of the endless rotation conveyance member in the inner circumference area, the fixed plate including an opening formed in a position corresponding to the ink discharge nozzles and a through-hole to suction a medium ejection part to catch a printed recording medium provided downstream of the inkjet recording device in the recording medium conveyance direction, wherein the blank discharge ink receiver is disposed corresponding to the opening of the fixed plate and in close contact with the fixed plate so that an inside space of the blank discharge receiver becomes a substantially closed space.

Other objects, features and advantages of the present invention will become more apparent from the following detailed description when read in conjunction with the accompanying drawings.

DETAILED DESCRIPTION OF THE PREFERRED EMBODIMENTS

Figure 4:
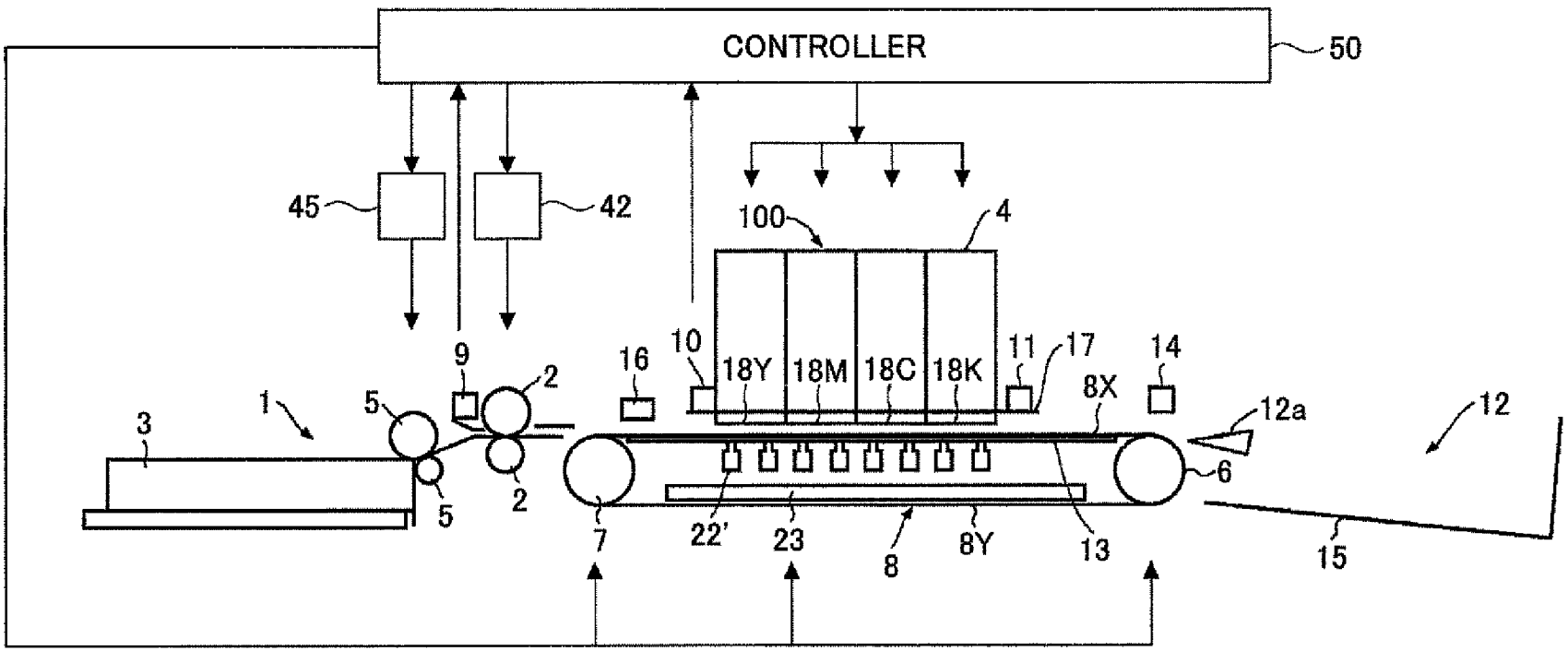
FIG. 4 is a side view showing a main part configuration of an image forming apparatus configured with an ink-jet recording apparatus in an embodiment of the present invention.

A description is given, with reference to the accompanying drawings, of embodiments of the present invention. To begin with, an explanation is given about an image forming apparatus configured with an inkjet recording apparatus in an embodiment of the present invention, with reference to FIG. 4 showing a main part configuration seen from a side view.

An image forming apparatus 100 is configured for color printing. A paper feeding part 1 is arranged on the left side of FIG. 4, and a paper ejection part 12 is arranged on the right side of FIG. 4. A paper conveyance path is formed inside the image forming apparatus 100 from the paper feeding part 1 to the paper ejection part 12. A pair of paper feeding rollers 5, 5 and a pair of resist rollers 2, 2 are provided just downstream of the paper feeding part 1, which is configured to send paper sheets 3 as recording media from the left side to the right side of FIG. 4.

In an intermediate part of the paper conveyance path, a conveyor belt 8 is provided so as to be hung and wrapped around two belt rollers 6, 7. The conveyor belt 8 is shaped into an endless loop, and constitutes an upper path 8X for conveying the paper sheets 3 and a lower path 8Y of a return route. The conveyor belt 8 includes many suction holes 8*a* (see FIG. 9) that double as openings for letting blank discharge ink through between the paper sheets 3 (see FIG. 9). The suction holes 8*a* form hole arrays arranged at a predetermined distance in a direction perpendicular to a paper sheet conveyance direction. The hole arrays are arranged at a predetermined distance from each other in the paper sheet conveyance direction. The holes included in the plural hole arrays are arranged so as to pass positions facing all of the nozzles in a recording head. To recognize a referenced hole array among the plural hole arrays, a belt standard hole array recognition marker is provided at a part of the conveyor belt 8 (which is not shown in drawings).

A suction fan 23 (see also FIG. 9) is installed inside the loop of the conveyor belt 8 as a suction unit for the paper sheets 3, which allows the paper sheet 3 sent by the pair of paper feed rollers 5, 5 and resist rollers 2, 2 to be conveyed toward the downstream direction by driving the belt roller 6, and suctioning the paper sheets 3 on a surface of the upper path 8X through the suction holes 8*a* (which are not shown in FIG. 4) provided through the conveyor belt 8.

An ink discharge unit 4 is provided at a position facing the surface of the upper path 8X in the conveyor belt 8, and the paper sheet conveyance path is formed in a gap between the lower surface of the discharge unit 4 and the upper path 8X of the conveyor belt 8. The ink discharge unit 4 is disposed as four color heads along the paper sheet conveyance direction, corresponding to four color inks (which include yellow Y, magenta M, cyan C, black B). In a lower part of each of the color heads corresponding to the four colors of the ink discharge head unit 4, for example, in a color head 18Y corresponding to the ink of yellow Y, a minute diameter nozzle is provided to discharge the ink onto the surface of the paper sheet 3 on the conveyor belt 8. The nozzles of each color heads are mutually arranged in a direction perpendicular to the paper sheet conveyance direction of the conveyor belt 8, and the arranged nozzles of the plural color heads constitute a head array and are mutually arranged at a predetermined distance. Furthermore, by shifting the head arrays adjacent in the paper sheet conveyance direction by a predetermined amount in a direction perpendicular to the paper sheet conveyance direction, the color heads are arranged in a zigzag formation, which constitutes a recording head 18 as a so-called line type head having a length corresponding to a width of the paper sheet 3. The other color heads corresponding to the other colors are arranged as well as the above-mentioned yellow color head 18Y, and constitute recording heads 18M, 18C, 18K. Moreover, the head arrays are fixed to a head base 17 that is a common member to set mutual positions.

Figure 5:
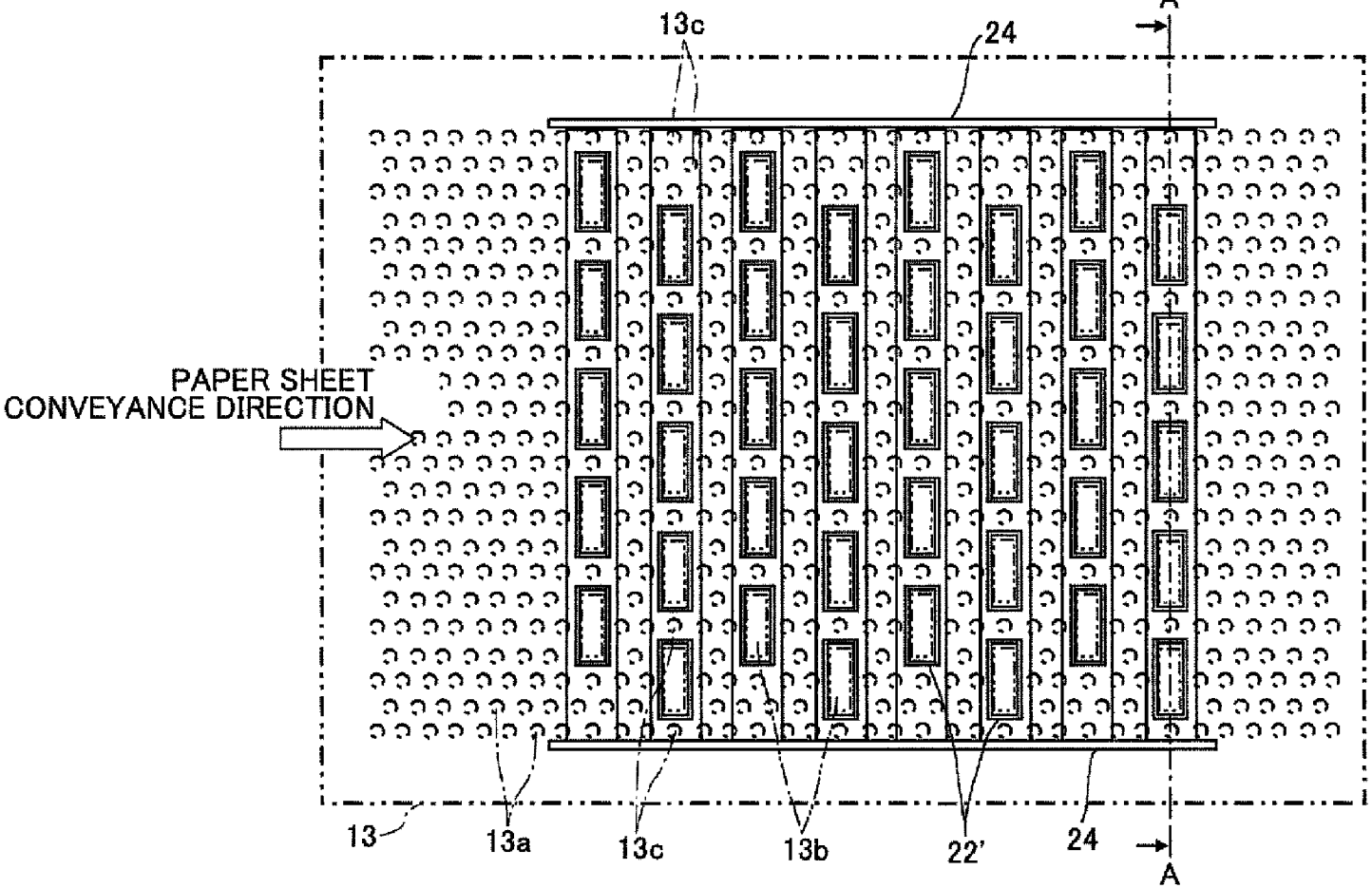
FIG. 5 is a top view of a blank discharge ink receiver of in the embodiment of the present invention.
Figure 6:
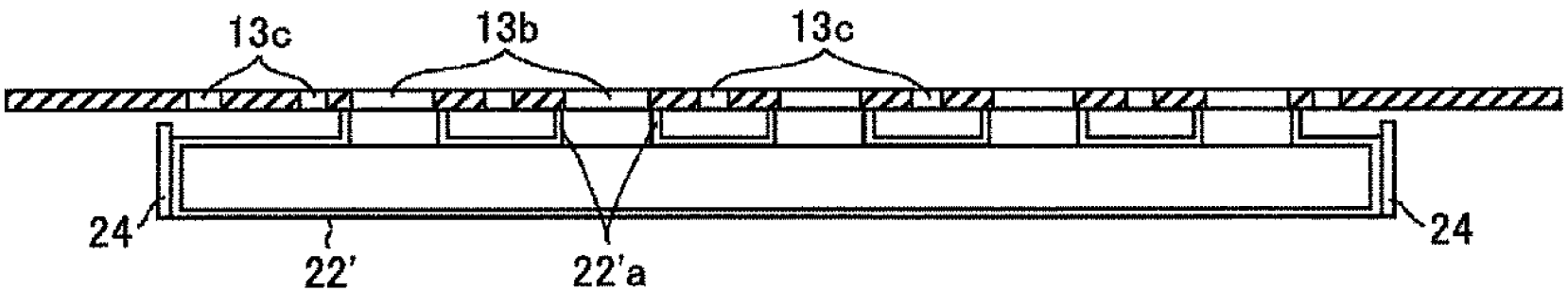
FIG. 6 is a cross-sectional view of FIG. 5 along a line A-A.

In addition, on a back side of the upper side path 8X facing the recording heads 18Y, 18M, 18C, 18K (i.e., inner circumference side of the conveyor belt 8), a flexure prevention member 13 is provided to prevent the conveyor belt 8 from sagging during the paper sheet conveyance. The flexure prevention member 13 includes openings 13*b* for blank discharge so as to face all of the head nozzles, and also includes suction holes 13*a* for paper suction only (see FIG. 5). Under the flexure prevention member 13, a blank discharge ink receiver 22' is provided connected to ink receiver side plates 24 (see FIG. 5 and FIG. 6). FIG. 5 shows an outline top view including the ink receiver side plates 24. To simplify the drawing, the ink discharge head unit 4, the conveyor belt 8 and so on are omitted. Each of the blank discharge receivers 22' has a shape slightly larger than the corresponding opening 13*b* for receiving the blank discharge, so as to encompass the opening 13*b* for the blank discharge ink. As is evident in FIG. 5, the suction holes 13*c* for the paper suction are also provided between the adjacent openings 13*b* for the blank discharge ink in a direction perpendicular to the paper sheet conveyance direction and outside the openings 13*b* disposed on both ends in a line. FIG. 6 shows a cross-sectional surface along the line A-A in FIG. 5 of one of the blank discharge ink receivers 22'. In the blank discharge ink receiver 22', only parts facing the openings 13*b* for the blank discharge ink constitute a shape for receiving the blank discharge ink by protruding more than the other shaped parts, and the top part 22'*a* is held to stick fast to a back surface of the flexure prevention member 13. The other areas have a shape separated from the back surface of the flexure prevention member 13 at a predetermined distance, so as not to prevent air flowing from suction holes 13*c*.

Due to these configurations, the paper sheet 3 conveyed on the upper side path 8X of the conveyor belt 8 passes under the four recording heads 18Y, 18M, 18C, 18K in sequence, maintaining a plane state. Then, a desired color image is formed by discharging the colors of ink from the corresponding head nozzles onto an upper surface (i.e., printing surface) of the paper sheet 3.

In FIG. 4, a first paper sheet detection part 9 lying between the pair of paper feeding rollers 5, 5 and the pair of resist rollers 2, 2, reads a position and a length in the conveyance direction of the paper sheet 3. A recording position detection part 10 attached to the ink discharge head unit 4 is for determining ink discharge timing onto the paper sheet 3, and doubles as a detection unit of the back end of the paper sheet 3. A second paper sheet detection part 11 lying downstream of the paper sheet conveyance direction of the ink discharge head unit 4 reads a position of the paper sheet 3. A paper sheet back end detection part 14 lying above the belt roller 6 of the downstream side is for detecting a paper jam or determining a next paper feed timing. Furthermore, the paper ejection part 12 includes a catch tray 15 that piles up the paper sheets 3 on which images are recorded, and a jump platform 12*a* to guide the under surface of the paper sheets 3 and to send out the paper sheets 3 to the catch tray 15.

Next, an explanation is given about the behavior of the image forming apparatus 100 configured as mentioned above. When a printing command for an image to be printed is carried out by an input unit (which is not shown in FIG. 4), an image memory stores the image data from a host computer through a communication interface (all of which are not shown in FIG. 4). A system controller 50 drives the paper feeding rollers 5, 5 with a paper feeding driver 45, and the paper feeding rollers 5, 5 separate and convey the top paper sheet 3 from the piled paper sheets 3 on the paper feeding part 1 toward the pair of resist rollers 2, 2 downstream of the paper sheet conveyance direction. Simultaneously, the system controller 50 drives the suction fan 23 disposed within the inner circumference of the conveyor belt 8, and the conveyor belt 8 begins a conveyance operation by starting to drive the belt roller 6 at a predetermined timing.

Next, when the system controller 50 receives a detection signal detected by the first paper sheet detection part 9, after a predetermined timing, the system controller 50 drives the pair of resist rollers 2, 2 with a resist roller driver 42, and the resist rollers 2, 2 convey the paper sheet 3 onto the surface of the conveyor belt 8 (i.e., the upper side path 8X). The conveyor belt 8 starts a suction-and-conveyance operation. When the system controller 50 detects the head of the paper sheet 3 reaching a sensor part of the recording position detection part 10, the system controller 50 makes the recording heads 18Y, 18M, 18C, 18K of the ink discharge head unit 4 record at predetermined timings based on the detection result. In other words, the image data stored in the image memory (which is not shown in FIG. 4) are sent to a print control part (which is not shown in FIG. 4) and are transformed into dot data of the colors through a head driver (which is not shown in FIG. 4). The head driver generates a drive control signal for each of the four recording heads 18Y, 18M, 18C, 18K. The nozzles discharge the ink onto the printing surface of the paper sheet 3 by the inputting of the generated drive control signals into the nozzles of the respective recording heads.

Since the print control part not shown in FIG. 4 controls the ink discharge timing of the four color recording heads 18Y, 18M, 18C, 18K, synchronizing with a conveyance speed of the paper sheet 3, and based on the detection result from the recording position detection part 10, it is possible to form an image without stopping the conveyance of the paper sheet 3. The paper sheet 3 on which an image is recorded is continuously conveyed by the conveyor belt 8 and ejected to the paper ejection part 12.

Next, a description is given about blank discharge. During printing or waiting, if use frequency of a certain nozzle decreases, and the nozzle does not discharge ink for more than a certain continuous time interval, a phenomenon occurs where an ink component in the vicinity of the nozzle evaporates and ink viscosity increases. Under these circumstances, the nozzle cannot discharge the ink even if an actuator (which is not shown in FIG. 4) inside the corresponding one of the recording heads 18Y, 18M, 18C, 18K is driven. Accordingly, to drive the actuator and to maintain a viscosity range capable of discharging before the phenomenon occurs, it is important to perform blank discharge so as to discharge deteriorated ink (i.e., ink near the nozzle whose viscosity increases). Control is set to perform the blank discharge after a predetermined elapsed time or a predetermined numbers of recordings (which includes the time of one recording). In other words, if the recording operation is continuously carried out by reaching the predetermined time or predetermined number of recordings (which includes the time of one recording), the system controller 50 preliminarily detects the head of the next paper sheet 3 to be conveyed with the first paper detection part 9. Then, the controller causes the nozzle in the recording head 18Y of the ink discharge head unit 4 to discharge the ink that does not contribute to printing through use of the head driver (which is not shown in FIG. 4), at a predetermined timing after the back end of the paper sheet 3 in current conveyance passes a detection position of the recording position detection part 10.

More specifically, after the back end of the paper sheet 3 in current conveyance passes the detection position of the recording position detection part 10, when a belt standard hole array detection sensor (which is not shown in FIG. 4) disposed upstream of the recording position detection part 10 detects a belt standard hole array recognition mark (which is not shown in FIG. 4) provided on the conveyor belt 8, the system controller 50 obtains a time until the standard hole array reaches a position facing the first recording head 18Y by operation. For all of the holes 13*b* belonging to plural hole arrays led by the belt standard hole array, the blank discharge is performed from the nozzles facing the corresponding holes 13*b* in the recording head 18Y in sequence. In other words, by utilizing a conveyance distance between the back end of the paper sheet 3 in current conveyance and the head of the next paper sheet 3 to be conveyed, when a gap between the paper sheets 3 back end and head comes to a position facing the head array of the recording head 18Y, the nozzles in the recording head 18Y discharge the ink for the blank discharge that does not contribute to printing toward the suction holes 8*a* disposed in the conveyor belt 8 so as to pass a position facing all of the head nozzles in the recording head 18Y.

The ink droplets discharged for the blank discharge pass through the suction hole 8*a* of the conveyor belt 8 and the opening 13*b* for the blank discharge ink in sequence, and further land on the blank discharge ink receiver 22' under the opening 13*b*. This allows the deteriorated ink whose viscosity has changed to be removed from the head nozzles in the recording head 18Y. FIG. 4 shows a configuration that includes two blank discharge ink receivers 22' for each color, in order to correspond to the zigzag formation by mutually adjacent nozzles in respective colors.

After the blank discharge in the recording head 18Y is carried out as mentioned above, in a similar way, as the hole array of the conveyor belt 8 moves to positions facing respective recording heads 18M, 18C, 18K in the ink discharge head unit 4 in sequence, the ink discharge that does not contribute to printing is performed from the respective recording heads 18M, 18C, 18K in sequence. In this case, the system controller 50 controls the ink discharge timing so that the ink for the blank discharge from the other recording heads 18M, 18C, 18K is discharged toward the almost same position as the hole 8*a* of the conveyor belt 8 toward which the ink is discharged from the recording head 18Y. That is, based on the detection result from the recording position detection part 10, for the hole 8*a* of the conveyor belt 8, the system controller 50 makes the nozzles of the other recording heads 18M, 18C, 18K discharge in sequence their blank discharge ink toward the same position as the blank discharge position of the ink by the recording head 18Y. A timing shifting way of the respective recording heads 18M, 18C, 18K in the blank discharge is the same as a timing shifting way of the respective recording heads 18M, 18C, 18K in usual printing. The difference is that the former way is based on the detection signal of the back end of the paper sheet 3 by the recording position detection part 10, while the latter way is based on the detection signal of the head of the paper sheet 3.

Figure 7:
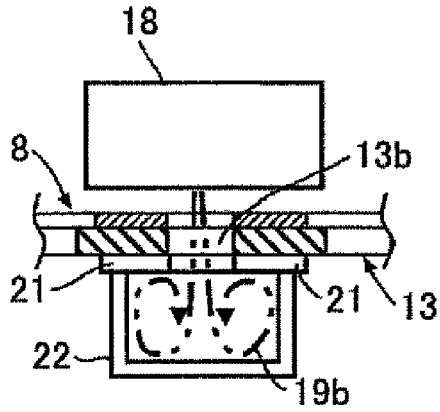
FIG. 7 is a view showing the blank discharge ink receiver seen from a direction perpendicular to a paper sheet conveyance direction in the embodiment of the present invention.

Next, a description is given about the blank discharge ink receiver of an embodiment of the present invention. FIG. 7 shows a first embodiment of the present invention. In the embodiment, elastic perforated packing 21 such as rubber is fitted on the back surface of the flexure prevention member 13 so that a hole of the perforated packing 21 fits in the opening 13*b* for the blank discharge ink. By sticking the blank discharge receiver 22 fast to the packing 21 at a predetermined pressure, a space inside the blank discharge receiver 22 is configured as an enclosed space encompassing its surroundings, except an opening facing the opening 13*b* for the blank discharge ink. According to the configuration, a blank discharge ink flow 19*b* discharged from the head nozzle in the recording head 18, after reaching a bottom surface of the blank discharge ink receiver 22, rises along a side wall and is introduced toward the bottom surface again, joining a subsequent blank discharge ink flow 19*b*. Furthermore, because the blank discharge ink flow 19*b* is unaffected by an air flow created by the suction fan 23, the blank discharge ink flow 19*b* remains static, and even a misty fine ink particle tends to pile up (which can be also called a stagnant ink flow 19*b*). As a result, it is possible to improve a recovery rate of the blank discharge ink and to prevent contamination except that of the blank discharge ink receiver by the leaking ink.

Figure 8:
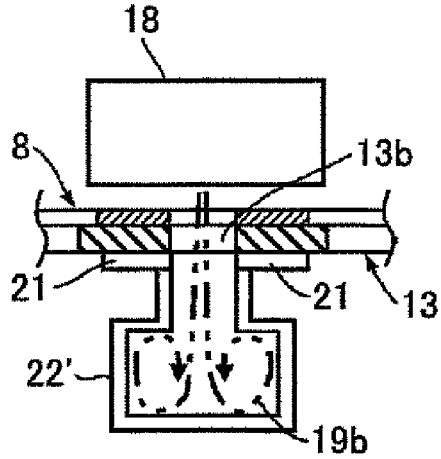
FIG. 8 is a view showing a blank discharge ink receiver seen from a direction perpendicular to a paper sheet conveyance direction in another embodiment of the present invention.

FIG. 8 shows another embodiment of a blank discharge receiver. The difference from FIG. 7 is that a cross section of a blank discharge receiver 22' is shaped into a convex (i.e., ⌂) shape. In addition, a cross section of the blank discharge ink receiver 22' in a direction perpendicular to the paper sheet conveyance direction may be shaped into a convex shape around all of the openings 13*b* for the blank discharge ink, as shown in FIG. 6.

Figure 1:
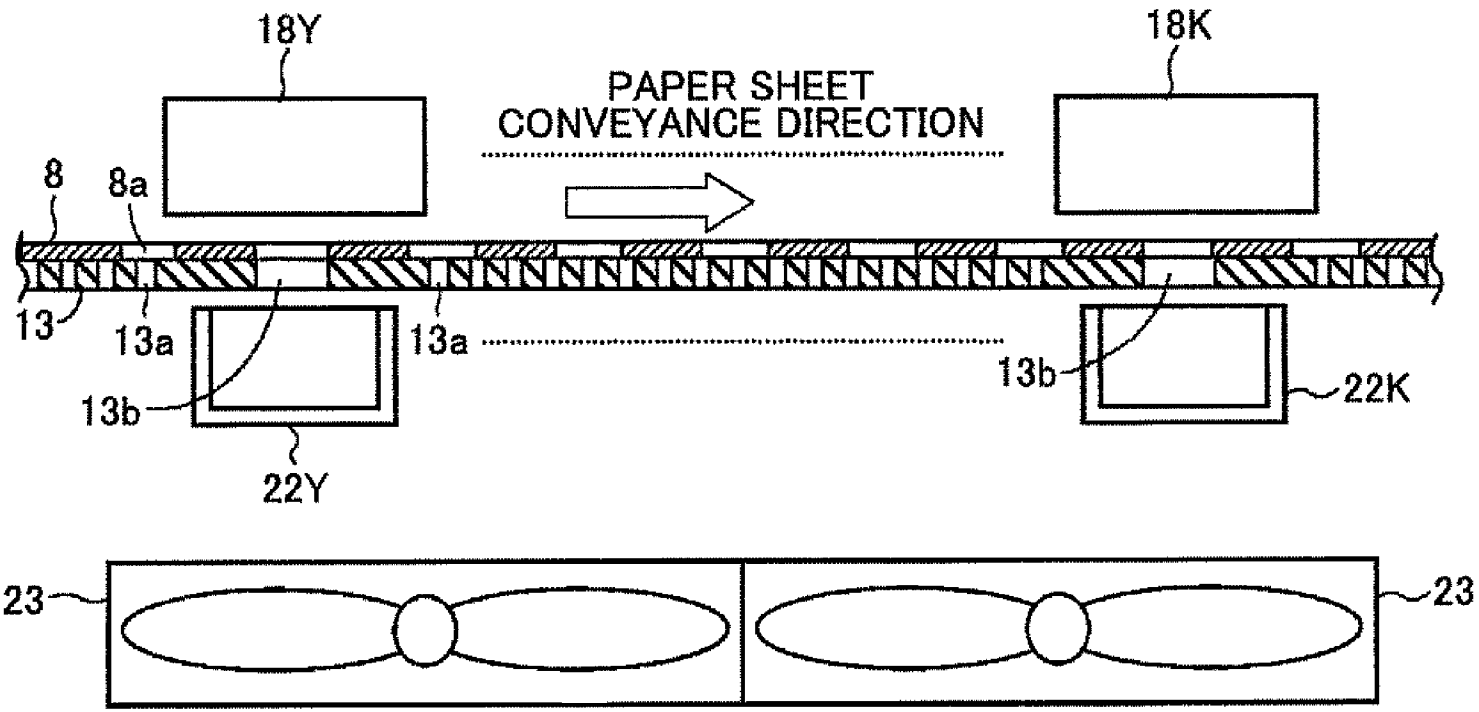
FIG. 1 is a view showing a conventional blank discharge ink receiver seen from a direction perpendicular to a paper sheet conveyance direction.
Figure 2:
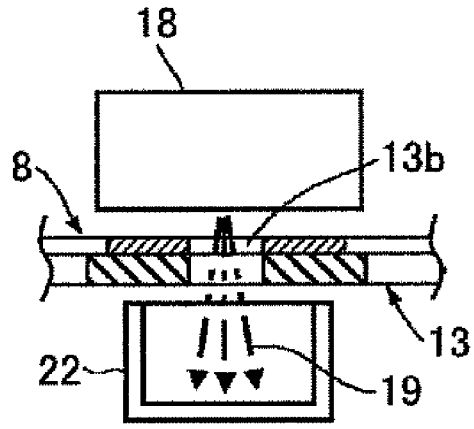
FIG. 2 is an outline view showing a blank discharge ink flow.
Figure 3:
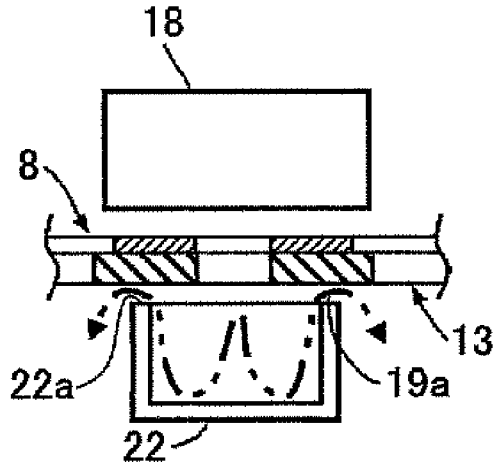
FIG. 3 is a view for explaining an outward ink flow.
Figure 9:
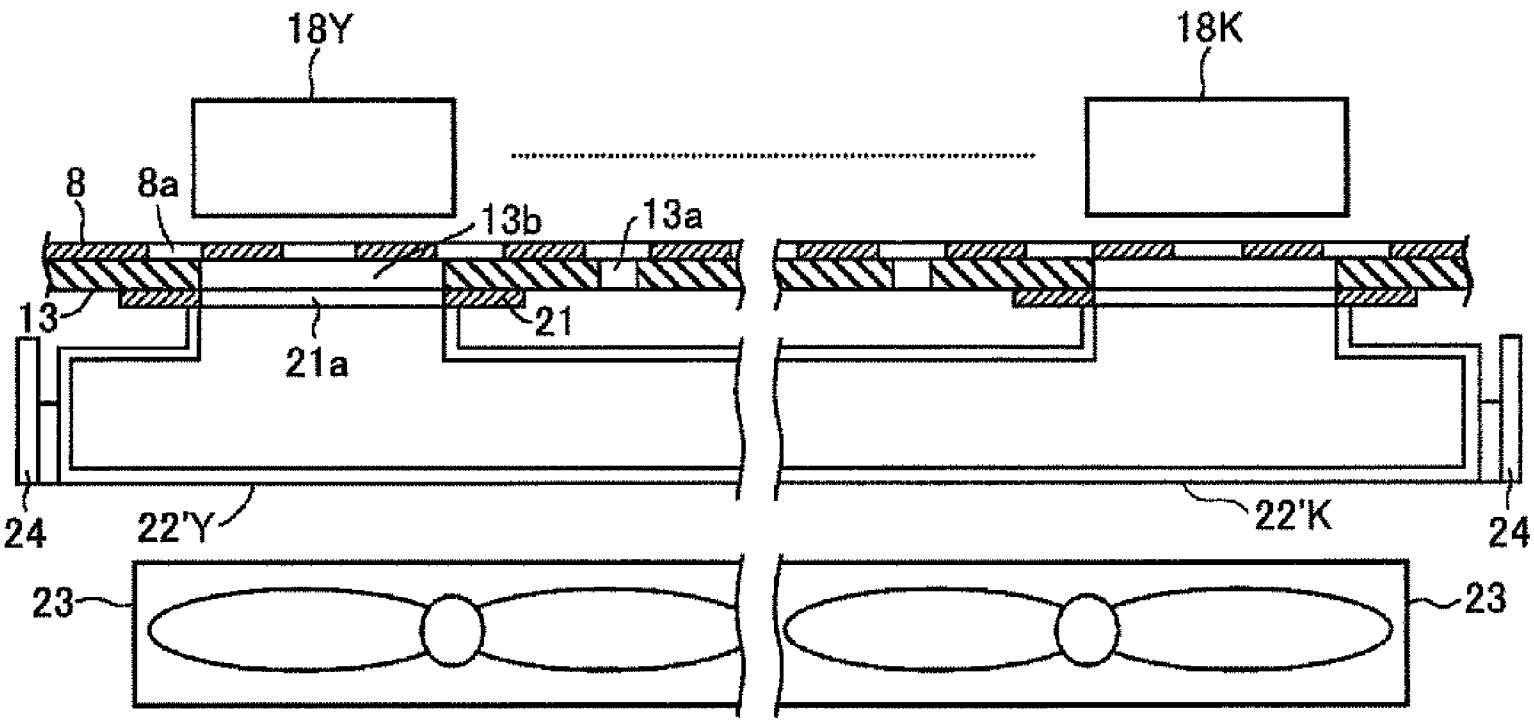
FIG. 9 is a cross-sectional view showing the blank discharge ink receiver shown in FIG. 8 seen from a direction parallel to the paper sheet conveyance direction in the embodiment of the present invention.

According to such a shape, when a blank discharge ink flow 19*b*, after reaching the bottom surface of the blank discharge ink receiver 22', rises along the side wall, it is difficult for the packing 21 to be contaminated by the blank discharge ink. In addition, if the blank discharge ink receiver 22' becomes full and is replaced with a new blank discharge ink receiver 22', the blank discharge ink receiver 22' has an advantage of preventing the ink attached to the packing 21 from dropping into the suction fan 23 located below. FIG. 9 shows a cross-sectional view of the blank discharge ink receiver 22' seen from a direction parallel to the paper sheet conveyance direction. This corresponds to FIG. 1. Since most components in FIG. 9 except the blank discharge ink receiver 22' are common to those in FIG. 1, the identical numerals are used for the common components, and a detailed description is given by the description of FIG. 5. There are a packing hole 21*a*, and ink receiver side plates 24. In the blank discharge ink receiver 22', by closing any parts facing the opening 13*b* for the blank discharge ink of the flexure prevention member 13 except an opening as shown in FIG. 9, it is possible to prevent an unnecessary adhesion of the blank discharge ink to the perforated packing 21 side.

Figure 10:
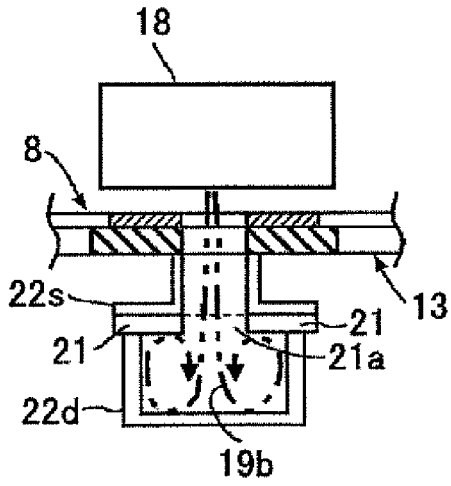
FIG. 10 is a view showing a third embodiment of the present invention.

FIG. 10 shows a third embodiment of a blank discharge ink receiver. In a configuration of the third embodiment, the blank discharge ink receiver is divided into two of a small blank discharge ink receiver 22*s* and a large blank discharge ink receiver 22*d*. The small blank discharge ink receiver 22*s* is fitted on a back surface of a flexure prevention member 13 in a unified manner without a gap, and a perforated packing 21 is fitted on the under surface of the small blank discharge ink receiver 22*s*. According to the configuration, in order to form the blank discharge ink receiver by combining simple shape blank discharge ink receivers 22*s*, 22*d* together, it is possible to reduce manufacturing cost. Also, according to this configuration, when the blank discharge ink receiver 22*d* is reset, or is replaced with a new blank discharge ink receiver 22*d*, the ink attached to the packing 21 might drop into the suction fan 23 located below as the embodiment in FIG. 7. However, because it is not necessary to accurately perform an alignment between an opening 13*b* for the blank discharge ink in a flexure prevention member 13 and an opening of the blank discharge ink receiver 22*d* as in the embodiment in FIG. 8, it is possible to work easily during maintenance.

Figure 11:
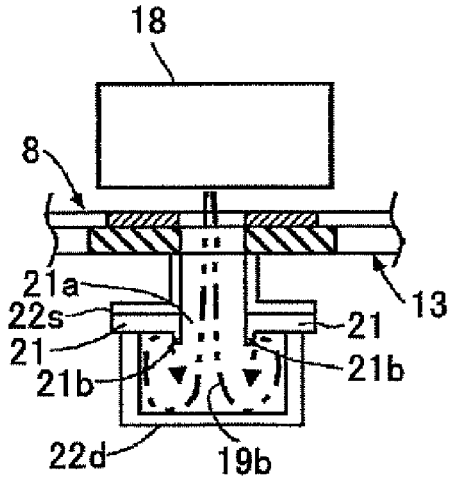
FIG. 11 is a view showing a fourth embodiment of the present invention.
Figure 12:
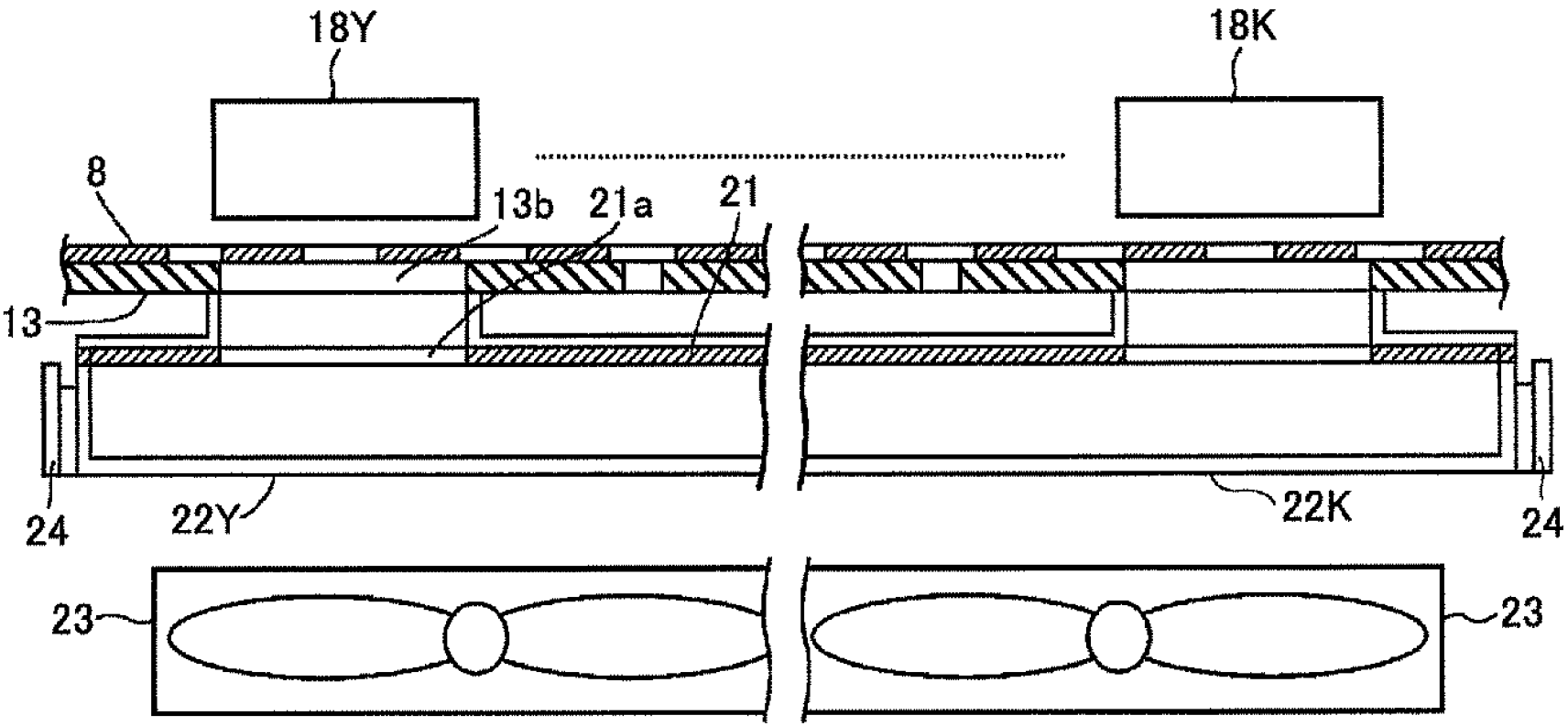
FIG. 12 is a cross-sectional view showing the blank discharge ink receiver shown in FIG. 10 and FIG. 11 seen from a direction parallel to the paper sheet conveyance direction in the embodiments of the present invention.

FIG. 11 shows a fourth embodiment of a blank discharge ink receiver. In a configuration of the fourth embodiment, a downward protrusion 21*b* is newly added to a part of the packing hole 21*a* circumference in FIG. 10. In this embodiment, the protrusion 21*b* functions as a current plate that introduce a blank discharge ink flow 19*b*, which rises along a circumference side wall after reaching the bottom surface, toward a bottom surface side of the blank discharge ink receiver 22*d* again. Moreover, the protrusion 21*b* has an effect of leading and letting down the ink that has become droplets resulting from the ink attached to the packing 21, the droplets gathering toward the bottom surface side of the blank discharge ink receiver 22*d*. Furthermore, to make gathering the droplet easier on the protrusion 21*b* side, the packing 21 may be shaped to have a downward slope toward the protrusion 21*b*. In addition, to make the droplets flow easier toward the protrusion 21*b*, a surface of the packing 21 has a water repellent effect. Also, a cross-sectional view of the blank discharge ink receiver 22 in FIG. 10 and FIG. 11 seen from a parallel direction to the paper sheet conveyance direction is shown in FIG. 12. FIG. 12 corresponds to FIG. 9.

Figure 13:
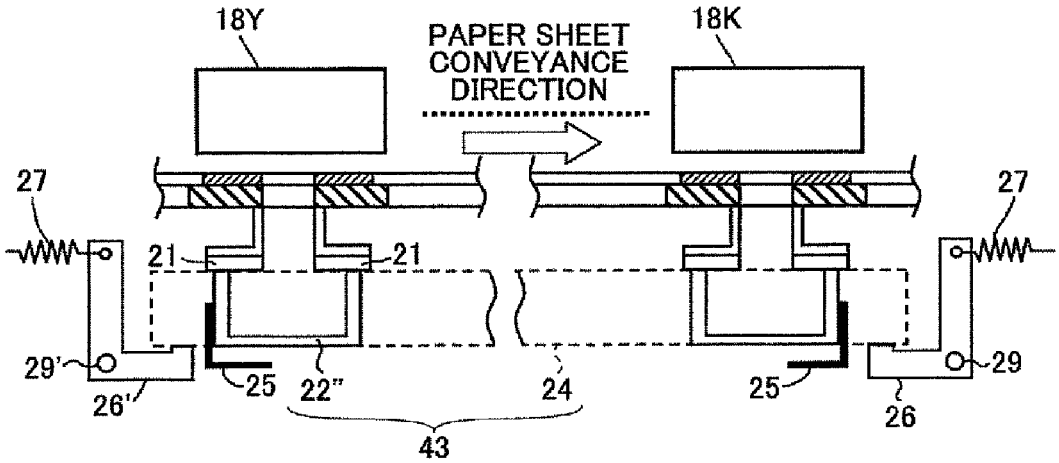
FIG. 13 is a view showing where a further provided pressurizing mechanism makes the blank discharge ink receiver stick fast to an elastic member.

FIG. 13 shows a configuration adding a pressurization/pressure release mechanism of a blank discharge ink receiver. In this example, plural blank discharge ink receivers 22" provided corresponding to recording heads 18Y to 18K are, as mentioned above, integrated by two ink receiver plates 24 (which is shown in a dotted line) one on each end in a longer direction (which corresponds to a direction perpendicular to the paper sheet conveyance direction) as a blank discharge ink receiver unit 43. In lower parts of the blank discharge ink receiver 22" in the most upstream and downstream parts in the paper sheet conveyance direction, two L letter shape slide rails 25 are provided to take a blank discharge ink receiver unit 43 in and out during maintenance. On both ends in the paper sheet conveyance direction of the ink receiver side plates 24 of a front side and back side in a direction perpendicular to a paper plane, pressurizing arms 26, 26' are provided. One of springs 27 biases the pressurizing arm 26 downstream of the paper sheet conveyance direction in a clockwise rotational direction, about an axis 29, and the other spring 27 biases the pressurizing arm 26' upstream of the paper sheet conveyance direction in a counterclockwise rotational direction, about an axis 29'. This makes top parts of the respective blank discharge ink receivers 22" stick fast to corresponding upper packings 21. In an adhered state, the pressurization/pressure release mechanism is set to have a predetermined gap between the respective blank discharge ink receivers 22" and the slide rails 25.

Figure 14:
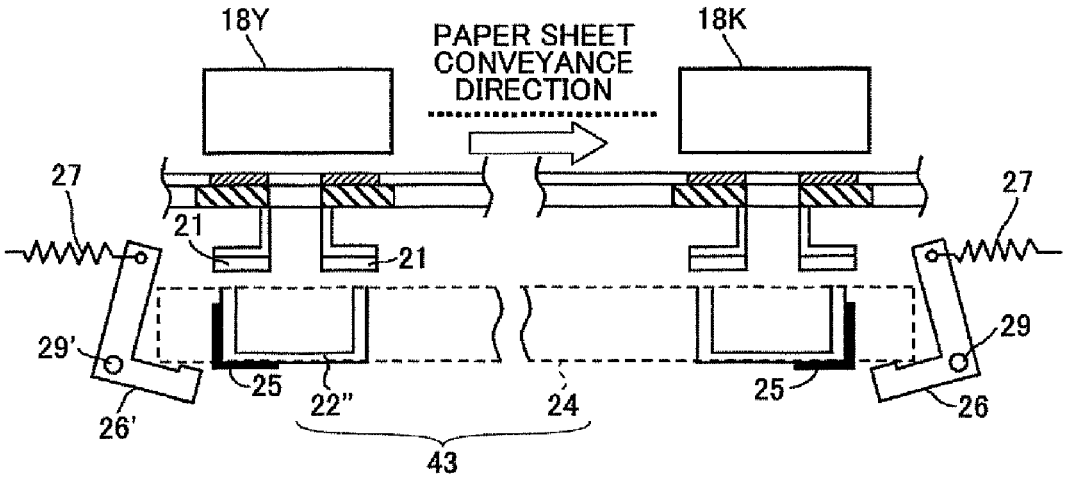
FIG. 14 is a view showing where the blank discharge ink receiver is separated from the elastic member by pressure release.

FIG. 14 is a view showing where the blank discharge ink receiver 22" is distant from the perforated packings 21. When the blank discharge ink receiver unit 43 is reset or is replaced with a new one, a pressure release mechanism including the springs 27 turns the pressurizing arm 26 downstream of the paper sheet conveyance direction in the counterclockwise direction, about the axis 29, and turns the pressurizing arm 26' upstream of the paper sheet conveyance direction in the clockwise direction, about the axis 29'. Since the blank discharge ink receiver unit 43 comes down due to its own weight to horizontal parts of the slide rails 25, it is possible to readily take the blank discharge ink receiver unit 43 in and out along the slide rails 25.

Figure 15:
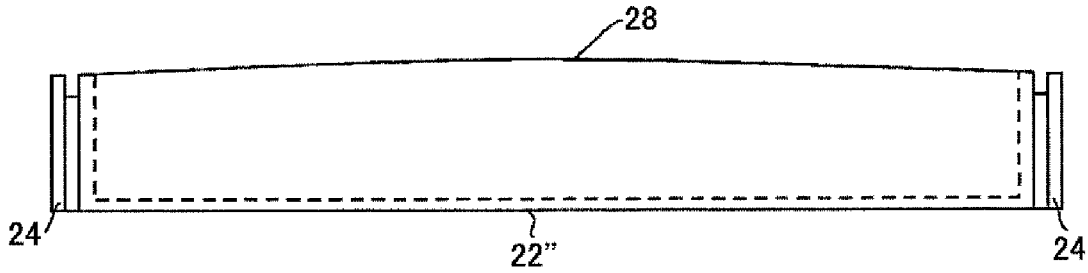
FIG. 15 is an outline view showing a top part configuration of the blank discharge ink receiver.

FIG. 15 shows a view of the blank discharge ink receivers 22" seen from a direction parallel to the paper sheet conveyance direction. In this example, rubber hardness or thickness of the blank discharge ink receiver 22" is optimized, and the blank discharge ink receiver 22" has a slight arc shape 28 in its top part so that adhesion degree of the blank discharge ink receiver 22" in a longer direction becomes almost uniform. In other words, this example adopts a method where the blank discharge ink receiver 22" sticks fast to the facing packing 21 without a gap, making the whole blank discharge ink receiver 22" bend, by lifting the respective ink receiver side plates 24 of front and back ends in a direction perpendicular to the paper plane.

Figure 16:
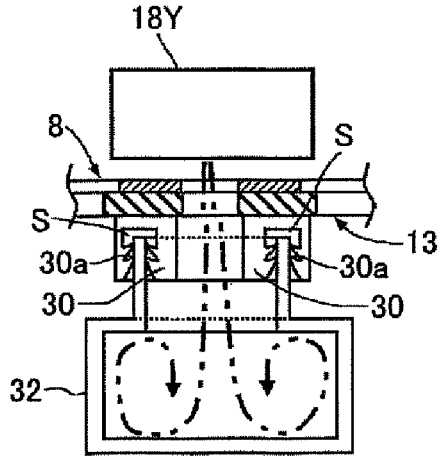
FIG. 16 is a side view showing another type of the blank discharge ink receiver of the present invention.
Figure 17:
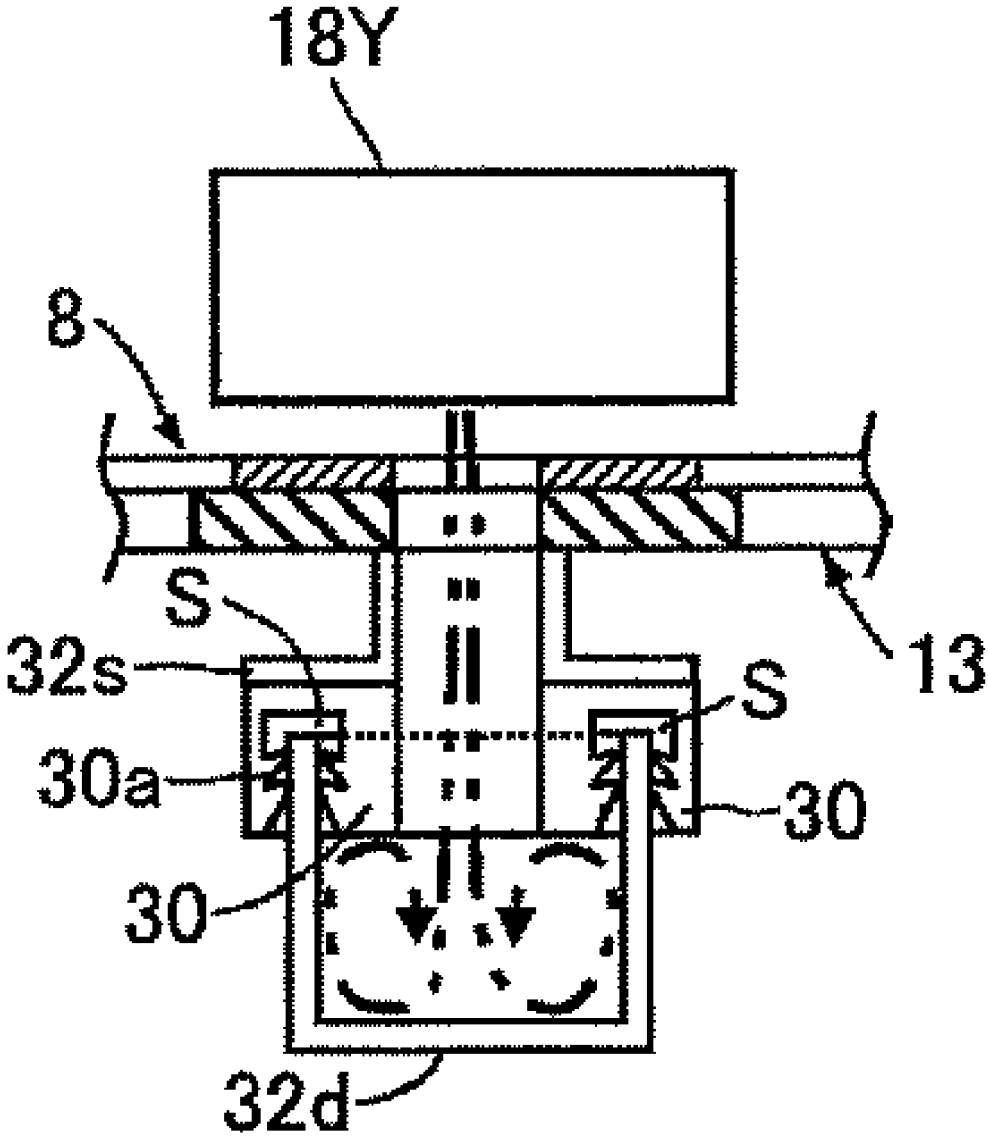
FIG. 17 is a side view showing a blank discharge ink receiver of another embodiment of the same type as FIG. 16.

FIG. 16 and FIG. 17 show another type of embodiment. In the above mentioned type, to improve the adhesion, the inside of the blank discharge ink receiver 22" is configured as an enclosed space encompassing its surroundings except the opening of the part facing the flexure prevention member 13, by pressing and sticking the top of the blank discharge ink receiver 22" to the facing surface of the packing 21 at a predetermined pressure. On the other hand, in this type, the inside of a blank discharge ink receiver 32 is configured as an enclosed space encompassing its surroundings except the opening of the part facing the flexure prevention member 13, in a featured form where a one side or both sides of a side wall part of the blank discharge ink receiver 32 is sandwiched by a lip shape parts 30*a* made of plural rows provided within an area of packing 30.

In this type, it is possible to make the inside of the blank discharge ink receiver 32 a necessary and sufficient enclosed space without pressing the blank discharge ink receiver 32 to the surface of the packing 30, as the above mentioned type. Depending on part accuracy of the blank discharge ink receiver, it happens to be difficult to make the sealing degree of all of the blank discharge ink receivers uniform. However, this type of the blank discharge ink receiver 32 is almost unaffected in sealing degree even if a shape of the top part, a width of an upper part of the blank discharge ink receiver 32, or other part's accuracy varies in some degree because the lip shape part 30*a* made of the plural rows provided within the packing 30 absorbs the variability. In other words, it is possible to reduce production cost of parts.

Figure 18:
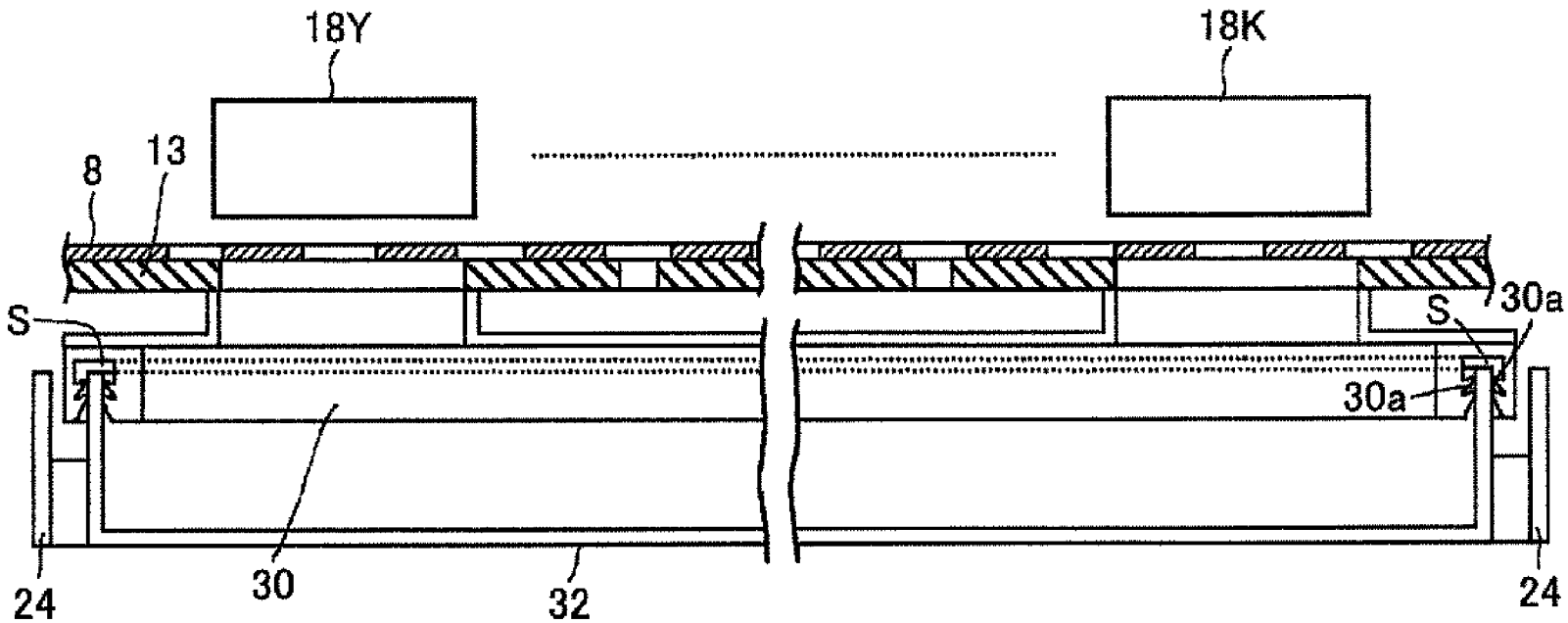
FIG. 18 is a cross-sectional view showing a sealing system of the blank discharge ink receiver in FIG. 17 seen from a direction parallel to the conveyance direction.

Furthermore, a mechanism to take the blank discharge ink receiver 32, 32*d* in and out during the maintenance may be a simple structure in a degree that there can be a gap S from the far end. This makes it possible to reduce the part cost. Also, a cross-sectional view of the blank discharge ink receiver 32 in FIG. 16 seen from a direction parallel to the paper sheet conveyance direction is shown in FIG. 18.

Figure 19:
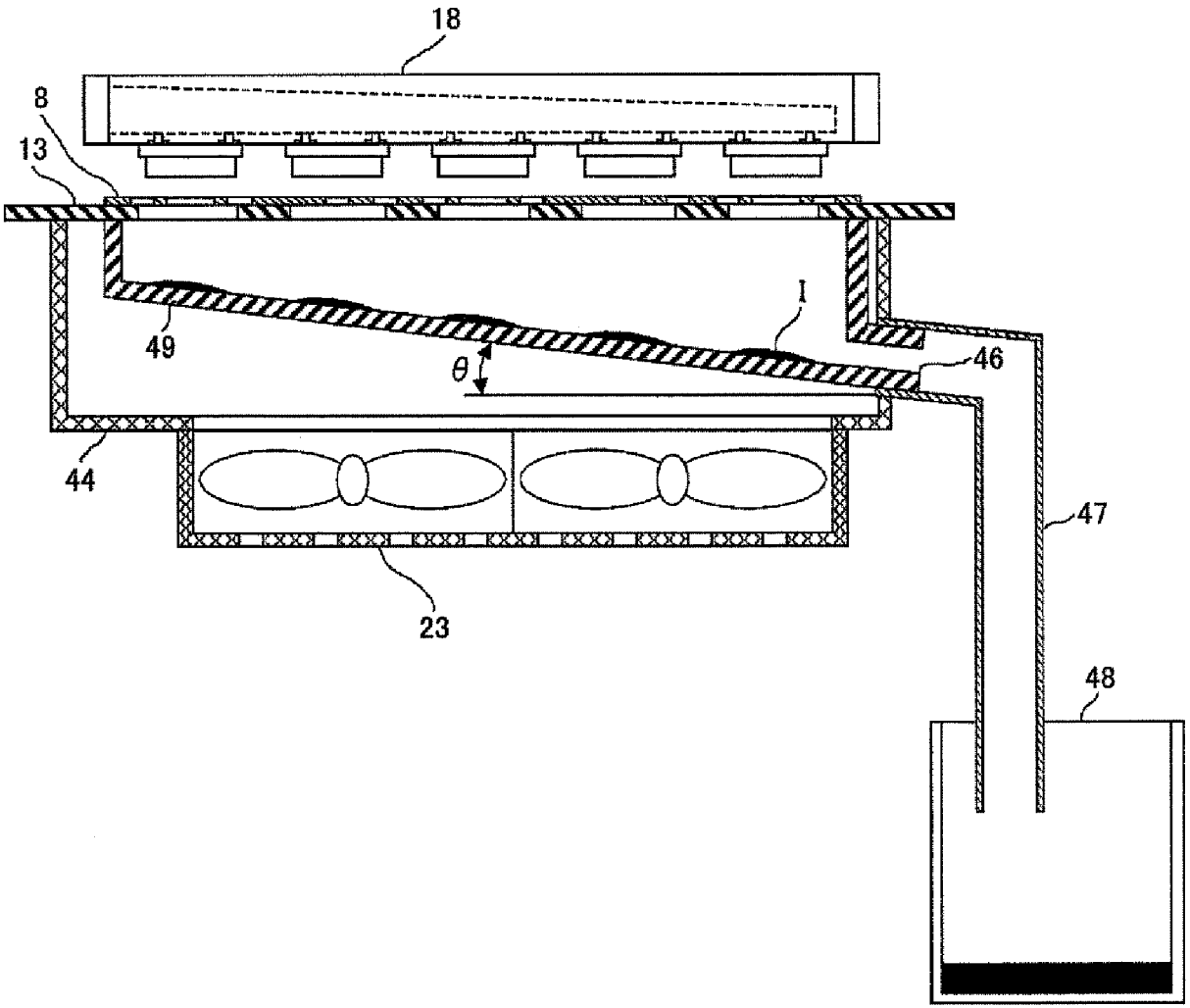
FIG. 19 is a view showing a configuration of a blank-discharge-ink-recovery-type blank discharge ink receiver seen from a direction perpendicular to the paper sheet conveyance direction.

The blank discharge ink receiver 22, 22', 22*s*, 22*d*, 22", 32, 32*d* described above suppose that the blank discharge ink receiver 22, 22', 22*s*, 22*d*, 22", 32, 32*d* have a configuration to accumulate the blank discharge ink from the respective head nozzles. Therefore, by providing the pressurization/pressure release mechanism of the blank discharge ink receiver 22, 22', 22*s*, 22*d*, 22", 32, 32*d*, the blank discharge ink receiver 22, 22', 22*s*, 22*d*, 22", 32, 32*d* or the blank discharge ink receiver unit 43 is replaced at a stage where the accumulated amount reaches a predetermined degree. Next, a description is given about a configuration in an embodiment that can recover blank discharge ink without exchanging a blank discharge ink receiver. FIG. 19 is a view showing a blank discharge ink receiver unit 44 in cross-section along the line A-A in FIG. 5 with the recording head 18 and the conveyor belt 8. The paper sheet 3 is conveyed from the front side to the back side toward the paper plane. The blank discharge ink receiver unit 44 fixed to a flexure prevention member 13 is provided with a suction fan 23 in an integrated way, and a blank discharge ink receiver plate 49 installed inside, sloping at a predetermined angle θ. An outlet 46 is formed at a side end of the blank discharge ink receiver unit 44, and the outlet 46 is connected to a downstream end of the sloping blank discharge ink receiver plate 49. A waste liquid tube 47 is fixed to the outlet 46, and the other end of the waste liquid tube 47 is connected to a waste tank 48. The waste liquid tube 47 forms a waste liquid path.

The inside space of the blank discharge ink receiver unit 44 substantially forms an enclosed space except openings for blank discharge ink, suction holes and the outlet 46 to the waste liquid path, within an area that is influenced by an air flow to suction the paper sheet 3 on the conveyor belt 8, formed by operation of the suction fan 23. According to such a configuration, ink I discharged for the blank discharge hits the blank discharge ink receiver plate 49, then goes out of the outlet 46 along the slope of the blank discharge ink receiver plate 49, and is recovered in the waste tank 48 through the waste liquid tube 47.

The embodiment in FIG. 19 has a configuration that integrates the suction fan 23 into the blank discharge ink receiver unit 44. Since the blank discharge ink receiver unit 44 exists alone, the air flow to suction the paper sheet 3 on the conveyor belt 8, formed by the operation of the suction fan 23, occurs through suction holes 13*a*, 13*c* in the flexure prevention member 13 outside an area the single blank discharge ink receiver occupies. In addition, the blank discharge ink receiver unit 44 is a single blank discharge ink receiver for a flat surface part of the conveyor belt 8 as mentioned above while the ink-accumulation-type blank discharge ink receivers are plurality disposed along the paper sheet conveyance direction of the conveyor belt 8 so as to face the corresponding head nozzles, as roughly shown in FIG. 4.

Moreover, by dividing the suction fan 23 from the blank discharge ink receiver, it is possible to configure the ink-recovery type blank discharge receiver so as to dispose the plural blank discharge ink receivers along the paper sheet conveyance direction of the conveyor belt 8, facing the head nozzles.

Also, in this case, by only a part facing the opening 13*b* for the blank discharge ink protruding in the blank discharge ink receiver, as shown in FIG. 6, and by setting the other parts away from surface of the flexure prevention member 13 (fixed plate), it is possible to take advantage of paper suction performance by the circumference of the opening 13*b* for the blank discharge ink being arranged in a main scanning direction or by the suction holes 13*c* being between the opening 13*b* arrays. Furthermore, as mentioned above, it is possible to provide a duct for the suction fan 23 so as to encompass the plural blank discharge ink receivers, as shown in FIG. 19.

Thus, according to an ink-jet recording apparatus and an image forming apparatus of the embodiments of the present invention, by providing a fixed plate along a circumference surface into an endless rotation conveyance member in an inner circumference area of the endless rotation conveyance member, by forming an opening at a position corresponding to an ink discharge nozzle and a through-hole for air suction into the fixed plate, by sticking a blank discharge ink receiver to the fixed plate without a gap, and by making an inside space of the blank discharge ink receiver an enclosed space except for an opening of a part corresponding to the opening of the fixed plate, it is possible to prevent blank discharge ink from leaking out of a gap between the fixed plate and the blank discharge ink receiver due to a negative pressure caused by an air flow for paper suction flowing in almost the same direction as an ink discharge direction. Moreover, it is possible to improve a recovery rate of the blank discharge ink and to prevent contamination other than that of the blank discharge ink receiver.

If the endless rotation conveyance member is a belt, by forming the fixed plate as a face plate of a surface bearing for the belt, instability of belt behavior can be solved. Furthermore, if plural through-holes are arranged to be able to correspond to all of the ink discharge nozzles, blank discharge can be performed to keep a sufficient discharge state in all of the arranged head nozzles.

If the blank discharge ink receiver is disposed extending in a array direction of the plural discharge nozzles so as to correspond to the plural discharge nozzles, and formed as a container having a protrusion part only in an area facing the fixed plate, one blank discharge ink receiver can cover the plural head nozzles arranged in a direction perpendicular to the paper sheet conveyance direction, which makes it possible to reduce a total number of the blank discharge ink receivers even if the number of head nozzles is many. In addition, by a part of the blank discharge ink receiver protruding at only a part facing the opening of the fixed plate, it is possible to provide the suction holes for the paper suction between the openings of the fixed plate, by which suction power of the paper sheet can be ensured. In addition, since the top shape of the blank discharge ink receiver becomes a convex shape in both directions perpendicular and parallel to the paper sheet conveyance direction, it is possible to keep an ink flow discharged into the discharge space in an area without the protrusion part of the blank discharge ink receiver when the ink flow rebounds from the bottom surface. This makes it possible to reduce an amount of the blank discharge ink possibly left between the blank discharge ink receiver and the fixed plate, and to improve the recovery rate. Also, if the fixed plate is provided with the protrusion part in an integrated manner, and the other part of the blank discharge ink receiver is formed as a member sticking to the protrusion part without a gap, production and installation of the blank discharge ink receiver becomes easier.

If close contact without a gap is realized by setting an elastic member between the blank discharge ink receiver and the fixed plate, it is possible to even improve the sealing degree by optimizing hardness or thickness of the elastic member that is used even if part accuracy used for a contact surface of the blank discharge ink receiver varies in some degree. By providing a pressurization/pressure release mechanism including a holding member movable between a holding position that realizes forming the enclosed space by pressing the blank discharge ink receiver to the fixed plate and a release position that opens the enclosed space by releasing the pressing operation, it is possible to certainly make the blank discharge ink receiver have a sealed state. Moreover, when the blank discharge ink receiver is taken in and out for maintenance and so on, it is possible to easily separate the blank discharge ink receiver from an opposite part, which can improve workability.

By forming an outlet for ink recovery at the blank discharge ink receiver, and by sloping the inside space of the blank discharge ink receiver to the outlet, the ink does not accumulate in the blank discharge ink receiver, so that time and effort to replace the blank discharge ink receiver does not occur. By disposing a tank to recover the blank discharge ink discharged from the outlet, disposing the recovered ink is easy.

The present invention is not limited to the specifically disclosed embodiments, and variations and modifications may be made without departing from the scope of the present invention.

The present application is based on Japanese Priority Patent Application No. 2009-62939, filed on Mar. 16, 2009, and Japanese Priority Patent Application No. 2009-237230, filed on Oct. 14, 2009, the entire contents of which are incorporated herein by reference.

What is claimed is:

1. An inkjet recording apparatus to print by discharging ink onto a surface of a recording medium comprising:

an endless rotation conveyance member with a plurality of first through-holes to support the recording medium on its surface;

a suction unit to suction the recording medium on the surface of the endless rotation conveyance member by suctioning air through the first through-holes of the endless rotation conveyance member;

a plurality of ink discharge heads including a plurality of ink discharge nozzles arranged in a direction perpendicular to a recording medium conveyance direction;

a blank discharge ink receiver to receive ink discharged from the ink discharge nozzles of the plurality of ink discharge heads and passing through the first through-holes, the blank discharge ink receiver being disposed in a position corresponding to the plurality of ink discharge nozzles in an inner circumference area of the endless rotation conveyance member;

a control unit to cause the ink discharge nozzles to discharge the ink when there is no recording medium on the endless rotation conveyance member and the first through-holes come to a position facing the ink discharge nozzles; and a fixed plate provided along an inner surface of the endless rotation conveyance member in the inner circumference area, the fixed plate including a plurality of openings having a size corresponding to an area where the ink discharge nozzles of the plurality of ink discharge heads are formed and located in a position corresponding to the plurality of ink discharge heads including ink discharge nozzles, and a plurality of second through-holes to suction air aside from the openings, the plurality of openings having a larger area than the second through-holes, wherein the blank discharge ink receiver is disposed corresponding to the openings of the fixed plate so as to seal an inside space of the blank discharge receiver as a substantially closed space except the plurality of openings, by contacting with a back surface of the fixed plate without a gap around the openings, and the blank discharge ink receiver is resettable or replaceable by being released from the fixed plate, and wherein the ink discharge heads discharge ink onto the blank discharge ink receiver for blank discharge in a state in which the blank discharge ink receiver is in close contact with the back surface of the fixed plate and an upper surface of the fixed plate is away from the ink discharge heads.

2. The inkjet recording apparatus as claimed in claim 1, wherein the endless rotation conveyance member is a belt, and the fixed plate is formed as a face plate of a surface bearing for the belt.

3. The inkjet recording apparatus as claimed in claim 1, wherein the plural through-holes of the endless rotation conveyance member are arranged capable of corresponding to all of the ink discharge nozzles.

4. The inkjet recording apparatus as claimed in claim 1, wherein the blank discharge ink receiver is arranged to extend in an array direction of the plural ink discharge nozzles, corresponding to the plural ink discharge nozzles, and is formed as a container including a protruding part only in an area facing the opening of the fixed plate.

5. The inkjet recording apparatus as claimed in claim 4, wherein the fixed plate is provided with the protruding part in a unified manner, and the other part of the blank discharge receiver is formed as a member sticking to the protruding part without a gap.

6. The inkjet recording apparatus as claimed in claim 3, wherein an elastic member lies between the blank discharge ink receiver and the fixed plate to realize close contact without a gap.

7. The inkjet recording apparatus as claimed in claim 1, further comprising:

a pressurizing/releasing mechanism including a holding member movable between a holding position to form the closed space by pressing the blank discharge ink receiver to the fixed plate and a releasing position to open the closed space by releasing a force pressing the blank discharge ink receiver.

8. The inkjet recording apparatus as claimed in claim 1, wherein the blank discharge ink receiver includes an outlet for ink recovery, and an inside of the blank discharge ink receiver slopes to the outlet.

9. The inkjet recording apparatus as claimed in claim 8, further comprising:

a tank to recover the blank discharge ink discharged from the outlet.

10. An image forming apparatus including an inkjet recording device to print by discharging ink onto a surface of a recording medium comprising:

a medium feeding part to provide the recording medium for the inkjet recording device provided upstream of the inkjet recording device in a recording medium conveyance direction;

an endless rotation conveyance member with a plurality of first through-holes to support the recording medium on its surface;

a suction unit to suction the recording medium on the surface of the endless rotation conveyance member by suctioning air through the first through-holes of the endless rotation conveyance member;

a plurality of ink discharge heads including a plurality of ink discharge nozzles arranged in a direction perpendicular to a recording medium conveyance direction;

a blank discharge ink receiver to receive ink discharged from the ink discharge nozzles of the plurality of ink discharge heads and passing through the first through-holes, the blank discharge ink receiver being disposed in a position corresponding to the plurality of ink discharge nozzles in an inner circumference area of the endless rotation conveyance member;

a control unit to cause the ink discharge nozzles to discharge the ink when there is no recording medium on the endless rotation conveyance member and the first through-holes come to a position facing the ink discharge nozzles;

a fixed plate provided along an inner surface of the endless rotation conveyance member in the inner circumference area, the fixed plate including a plurality of openings having a size corresponding to an area where the ink discharge nozzles of the plurality of ink discharge heads are formed and located in a position corresponding to the plurality of ink discharge heads including the ink discharge nozzles, and a plurality of second through-holes to suction air aside from the openings, the plurality of openings having a larger area than the second through-holes; and a medium ejection part to catch a printed recording medium provided downstream of the inkjet recording device in the recording medium conveyance direction, wherein the blank discharge ink receiver is disposed corresponding to the openings of the fixed plate so as to seal an inside space of the blank discharge receiver as a substantially closed space except the plurality of openings, by contacting with a back surface of the fixed plate without a gap around the openings, and the blank discharge ink receiver is resettable or replaceable by being released from the fixed plate, and wherein the ink discharge heads discharge ink onto the blank discharge ink receiver for blank discharge in a state in which the blank discharge ink receiver is in close contact with the back surface of the fixed plate and an upper surface of the fixed plate is away from the ink discharge heads.

11. The inkjet recording apparatus as claimed in claim 1, wherein the blank discharge ink receiver includes a top part contacting with the back surface of the fixed plate and a body part, the top part protruding from the body part so that a cross section is shaped into a convex shape as a whole, and a width of the body part is wider than a width of the top part.

12. The inkjet recording apparatus as claimed in claim 1, wherein the plurality of openings are substantially shaped into a rectangle, and the plurality of second through-holes are substantially shaped into a circle.

13. The inkjet recording apparatus as claimed in claim 1, wherein the body part of the blank discharge ink receiver is separated from the back surface of the fixed plate at a predetermined distance so as not to prevent air flowing from the second through-holes.

14. The inkjet recording apparatus as claimed in claim 1, wherein a second opening of the blank discharge receiver that functions as an entrance of the ink has a substantially same size as the openings of the fixed plate, and the blank discharge ink receiver sticks fast to the fixed plate without the gap so as to surround the opening of the plate.

15. The inkjet recording apparatus as claimed in claim 6, wherein the elastic member includes a concave part and lip parts made of plural rows in the concave part to sandwich one of one side and both sides of a side wall part of the top part of the blank discharge ink receiver and lip.

* * * * *